US010788223B2

(12) United States Patent
Yang et al.

(10) Patent No.: US 10,788,223 B2
(45) Date of Patent: Sep. 29, 2020

(54) BLOWER

(71) Applicant: LG ELECTRONICS INC., Seoul (KR)

(72) Inventors: Inhyung Yang, Seoul (KR); Daeyun Park, Seoul (KR); Jongseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 32 days.

(21) Appl. No.: 15/803,183

(22) Filed: Nov. 3, 2017

(65) Prior Publication Data

US 2018/0128496 A1 May 10, 2018

(30) Foreign Application Priority Data

Nov. 4, 2016 (KR) ..... 10-2016-0146410

(51) Int. Cl.

| | |
|---|---|
| ***F24D 5/02*** | (2006.01) |
| ***F26B 21/00*** | (2006.01) |
| ***F24F 11/72*** | (2018.01) |
| ***F24F 7/007*** | (2006.01) |
| ***F24F 7/10*** | (2006.01) |
| ***F24F 11/30*** | (2018.01) |
| ***F26B 9/02*** | (2006.01) |
| *F24F 120/10* | (2018.01) |

(52) U.S. Cl.

CPC ..... *F24D 5/02* (2013.01); *F24F 11/30* (2018.01); *F24F 11/72* (2018.01); *F26B 9/02* (2013.01); *F26B 21/001* (2013.01); *F24F 7/007* (2013.01); *F24F 7/10* (2013.01); *F24F 2120/10* (2018.01)

(58) Field of Classification Search

CPC .. F24D 5/02; F26B 21/001; F26B 9/02; F26B 3/06; F26B 21/004; F24F 11/72; F24F 11/30; F24F 7/007; F24F 2120/10; F24F 7/10; A47K 10/48

IPC ..... F24D 5/02

See application file for complete search history.

(56) References Cited

U.S. PATENT DOCUMENTS

2015/0273851 A1 10/2015 Akahane et al.

FOREIGN PATENT DOCUMENTS

| | | |
|---|---|---|
| CN | 202752136 | 2/2013 |
| CN | 203029061 | 7/2013 |
| CN | 203980852 | 12/2014 |
| CN | 104644036 | 5/2015 |
| CN | 204520455 | 8/2015 |

(Continued)

OTHER PUBLICATIONS

Chinese Office Action dated Jul. 18, 2019 issued in CN Application No. 201711071902.4.

*Primary Examiner* — David Redding
(74) *Attorney, Agent, or Firm* — Ked & Associates, LLP

(57) ABSTRACT

Disclosed is a blower including a blower main body configured to move air from a main body suction port formed in a lower end thereof to a main body discharge port formed in an upper end thereof using an air-conditioning module provided therein, and a variable nozzle connected to the upper end of the blower main body so as to suction the air moved from the blower main body through a nozzle suction port thereof and discharge the air through a nozzle discharge port thereof, the variable nozzle including a pair of nozzle guides provided therein to adjust a partial pressure of the air to be discharged through the nozzle discharge port.

19 Claims, 8 Drawing Sheets

(56) References Cited

FOREIGN PATENT DOCUMENTS

| | | | |
|---|---|---|---|
| CN | 104943383 | | 9/2015 |
| CN | 204618068 | | 9/2015 |
| CN | 105239652 | | 1/2016 |
| JP | 2006-192250 | | 7/2006 |
| JP | 2013-153922 | | 8/2013 |
| KR | 2005059377 | * | 6/2005 |
| KR | 10-2007-0042150 | | 4/2007 |
| KR | 1533103 B1 | * | 7/2015 |

* cited by examiner

BLOWER

CROSS-REFERENCE TO RELATED APPLICATION

This application claims priority under 35 U.S.C. § 119 to Korean Application No. 10-2016-0146410, filed on Nov. 4, 2016, whose entire disclosure is hereby incorporated by reference.

BACKGROUND

1. Field

The present disclosure relates to a washstand cabinet provided under a washstand, and more particularly, to a washstand cabinet in which an electrically-operated module is accommodated.

2. Background

Water is frequently used in a bathroom, and water may accumulate on the bathroom walls and floor. Moreover, unattractive scaling associated with deposits left after the water evaporates may occur when the water present on the bathroom walls or floor is not promptly removed.

Korean Patent Laid-Open Publication No. 10-2007-0042150 describes a device provided in a bathroom that provides an air circulation throughout the bathroom to dry some of the water present in the bathroom. However, this type of device that circulates air throughout a bathroom generally cannot completely remove all water in a bathroom, such as, for example, water remaining in a corner of the bathroom. The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements, and wherein.

DETAILED DESCRIPTION

Figure 1:
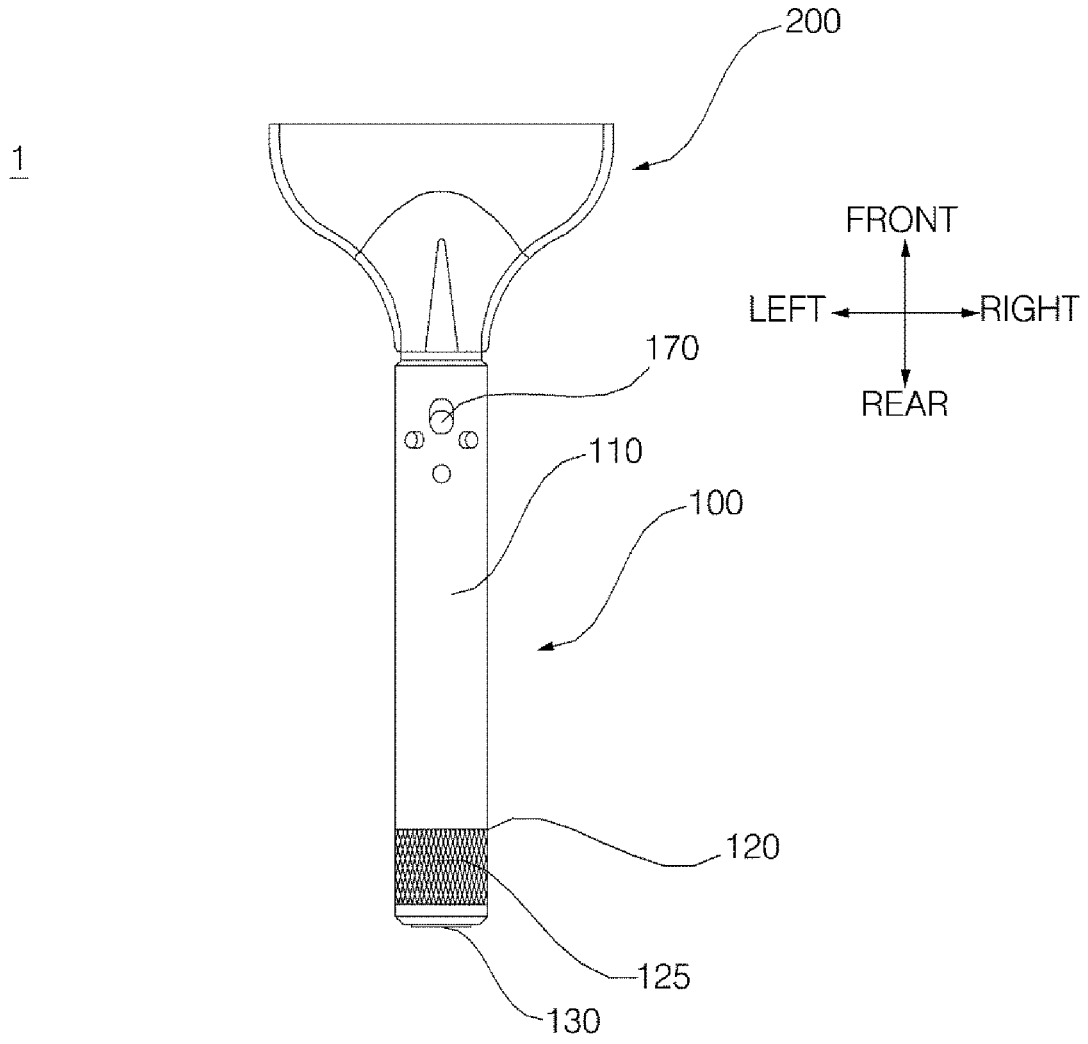
FIG. 1 is a view illustrating a blower according to an embodiment of the present disclosure.
Figure 2:
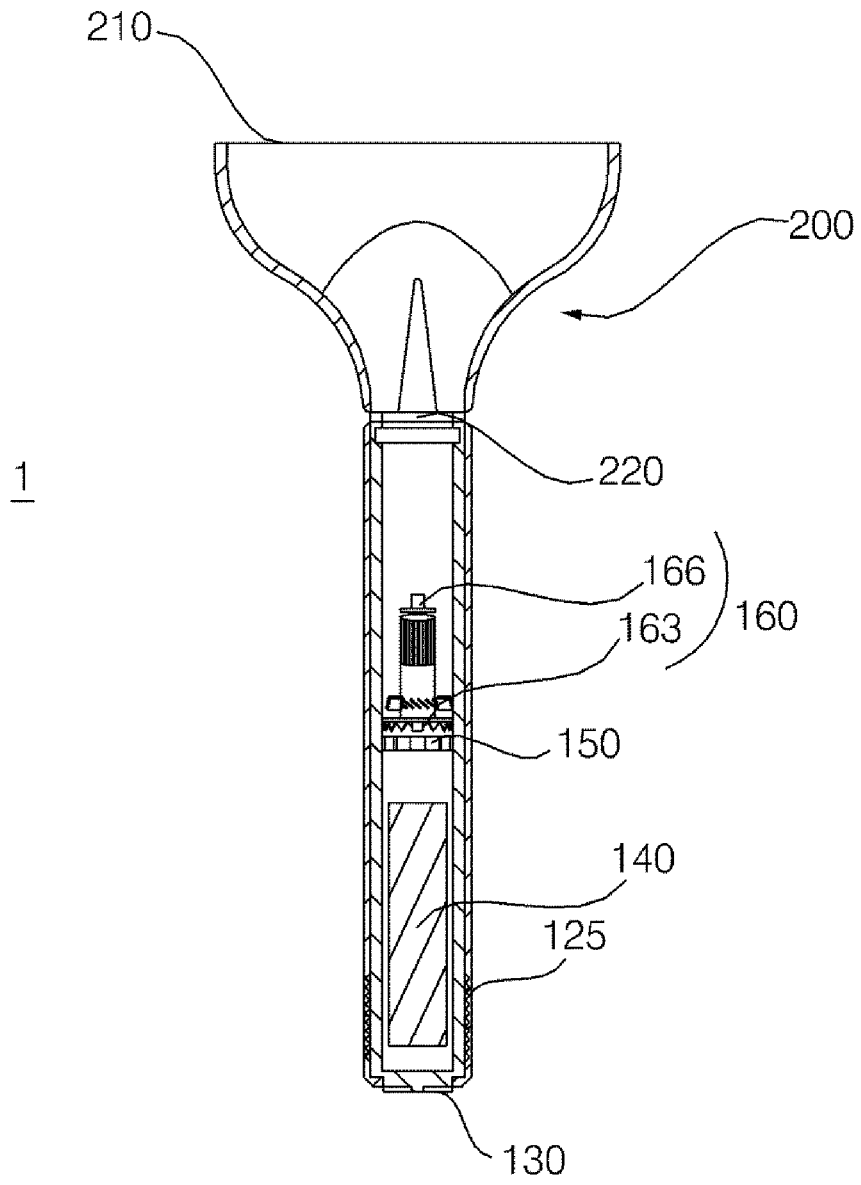
FIG. 2 is a view for explaining the inside of a blower main body according to an embodiment of the present disclosure.

Hereinafter, the present disclosure will be described with reference to the accompanying drawings to explain a washstand cabinet including a blower or a drying module according to embodiments of the present disclosure.

As shown in FIGS. 1 to 4, a blower 1 according to one embodiment may include a blower main body 100 and a variable nozzle. The blower main body may move air from a main body suction port 120 formed in the lower end thereof to a main body discharge port 180 formed in the upper end thereof using an air-conditioning module (or dryer module) 160 provided therein. The variable nozzle 200, may be connected to the upper end of the blower main body 100 (e.g., adjacent to the main body discharge port 180) so as to discharge the air from the blower main body 100 through a nozzle discharge port 210, and the variable nozzle 200 may be configured to adjust the partial pressure of the air flow discharged through the nozzle discharge port 210 using a nozzle guide 230 provided therein.

The blower 1 according to the present embodiment may move air to the variable nozzle 200 through the blower main body 100. The nozzle guide 230 provided inside the variable nozzle 200 may be moved to change position within the nozzle so that the outputted air may be discharged at different pressures at the left and right sides and/or the center of the nozzle discharge port 210.

The blower main body 100 may suction air from the main body suction port 120 formed in the lower end thereof (e.g., opposite the nozzle 200) and may discharge the air through the main body discharge port 180 formed in the upper end thereof (e.g., adjacent to the nozzle 200). The blower main body 100 may include a case 110 having an elongated cylindrical shape to define the external shape of the blower main body 100, and the air-conditioning module (or dryer module) 160 may be provided inside the case 110 to move the air inside the case 110. The blower main body 100 may further include a rechargeable battery 140 that supplies power to the air-conditioning module 160, and a charge terminal 130 that charges the rechargeable battery 140 from an external power source, such as a commercial power receptacle.

The case 110 may be provided with the main body suction port 120 in the peripheral direction of the lower end thereof. The case 110 may be provided with the main body discharge port 180 in the upper surface thereof to discharge air. The case 110 has an elongated cylindrical shape. The cylindrical case 110 may have a diameter that allows the user to grip the case 110 with his/her hand.

In the main body suction port 120, a pre-filter 125 may be provided to primarily filter foreign substances in the air. The pre-filter 125 may have a perforated structure with holes or openings that are sized to primarily or initially filter foreign substances in the air that may be suctioned through the main body suction port 120. An inner filter 150 may further be provided inside the case 110 to secondarily additional filter foreign substances in the air to be introduced into the air-conditioning module 160 (e.g., the air that has been initially filtered by the pre-filter 125). The inner filter 150 may have a perforated structure with holes or openings that are relatively smaller than the openings in the pre-filter 125.

The air-conditioning module 160 may include a fan 163 that moves air via rotation thereof, and a motor 166 that drives the rotation of the fan 163. The air-conditioning module 160 may be provided inside the case 110, such as in the cavity formed within the cylindrical body. The air-conditioning module 160 may suction air through the main body suction port 120 formed at a distal end of the case 110 away from the nozzle 200, such as the lower end of the case 110. The air-conditioning module 160 may then discharge the air to the main body discharge port 180 formed in the upper end of the case 110 and adjacent to the nozzle 200.

The rechargeable battery 140 may be provided inside the case 110. The charge terminal 130 may be provided on the lower surface of the case 110. The charge terminal 130 according to one embodiment may charge the rechargeable battery 140 when receiving power from the external power source. When the charge terminal 130 may be mounted to a washstand cabinet 10, which will be described below, the charge terminal 130 may serve as a control terminal that controls the air-conditioning module 160 inside the blower main body 100 in response to a command input via an input unit of the washstand cabinet 10.

The blower main body 100 may further include a control switch 170, which selectively operates the motor 166 and the fan 163 inside the case 110. The control switch 170 may be provided on the upper portion of the case 110. The control switch 170 may control power of the blower 1. In another example, the control switch 170 may change a position of the nozzle guide 230 inside the variable nozzle 200, as will be described below. In addition, the control switch 170 may perform control to adjust the flow rate of air in the air-conditioning module 160.

The variable nozzle 200 may discharge the air introduced from the blower main body 100 through the nozzle discharge port 210. The nozzle discharge port 210 of the variable nozzle 200 may be shaped like an oblong slit that is relatively narrow in a first direction (e.g., along a minor axis) and is relatively long in a transverse, second direction (e.g., along a major axis). When the nozzle discharge port 210 has the slit shape, air may be injected in a wide range toward, for example, the bathroom floor or wall. In addition, when the nozzle discharge port 210 has the slit shape, water present on, for example, the bathroom floor or wall may be removed via, for example, forced convection by an air flow through the discharge port.

Referring to FIG. 1, in the description of the variable nozzle 200 according to the present embodiment, the direction in which the nozzle discharge port 210 and the nozzle suction port 220 may be aligned may be referred to as the front-and-rear direction, the direction in which the nozzle discharge port 210 gradually increases in width may be referred to as the left-and-right direction, and the direction orthogonal to both the front-and-rear direction and the left-and-right direction may be referred to as the vertical direction. The above-identified front-and-rear direction, the left-and-right direction and the vertical direction are given as examples to explain attributes of the variable nozzle of the present embodiment, and these directions are not intended to limit the scope of the present disclosure. For example, the nozzle discharge port 210 may have a differently shaped opening and/or the opening may be positioned in a different orientation.

In order to allow the variable nozzle 200 to discharge air within a wide range, the nozzle discharge port 210 may extend relatively longer in the left-and-right direction and may be relatively shorter in the vertical direction.

The nozzle suction port 220 of the variable nozzle 200 may have a shape corresponding to the blower main body 100. For example, the nozzle suction port 220 may have a circular shape so as to correspond to opening of the cylindrical blower main body 100. A flow path defined in the variable nozzle 200 may become narrower in the vertical direction and may become relatively wider in the left-and-right direction with increasing distance from the nozzle suction port 220 or decreasing distance to the nozzle discharge port 210.

Inside the variable nozzle 200 according to the present embodiment, the nozzle guide 230 may be provided to adjust the partial pressure of the air discharged through the nozzle discharge port 210. In one example, a pair of nozzle guides 230 may be provided symmetrically about a virtual left-and-right center axis 240 formed in the center of the longitudinal direction of the variable nozzle 200. The two nozzle guides 230 may be configured so that the more that the two nozzle guides 230 are farther away from the from the nozzle suction port 220 and closer to the nozzle discharge port 210, the farther the two nozzle guides 230 are positioned away from the left-and-right center axis 240.

The nozzle guides 230 may be provided inside the variable nozzle 200. The nozzle guides 230 may guide the air moving inside the variable nozzle 200. The partial pressure of the air to be discharged may be changed depending on the orientation of the nozzle guides 230. As the orientation of the nozzle guides 230 is changed, the air discharged through the nozzle discharge port 210 may exert high pressure in the left and right sides of the nozzle discharge port 210 as illustrated in section (a) of FIG. 3, may exert high pressure in the center of the nozzle discharge port 210 as illustrated in section (c) of FIG. 3, or may exert even pressure throughout the nozzle discharge port 210 as illustrated in section (b) of FIG. 3.

Each of the nozzle guides 230 may include a fixed guide 232, which extends from the nozzle discharge port 210 and may be provided at a fixed position, and a movable guide 234, which extends from the nozzle suction port 220 and may be movably provided, and a hinge point 236, which causes change in the orientation of the movable guide 234. The hinge point 236 may be the reference position about which the orientation of the movable guide 234 is changed.

In one example, the pair of nozzle guides 230 may include a pair of fixed guides 232, a pair of hinge points 236, and a pair of movable guides 234. The pair of fixed guides 232 may extend from the hinge points 236 and toward the nozzle discharge port 210. The pair of fixed guides 232 may be provided so as to be positioned farther away from the left-and-right center axis 240 with decreasing distance to the nozzle discharge port 210.

When the pair of movable guides 234 extends from the hinge points 236 to the nozzle suction port 220, the movable guides 234 may be changed in orientation about the respective hinge points 236 so as to rotate relative to the left-and-right center axis 240. The adjacent ends of the pair of movable guides 234 that are close to the nozzle suction port 220 may be moved so as to gather to or be farther away from the left-and-right center axis 240.

Figure 3:
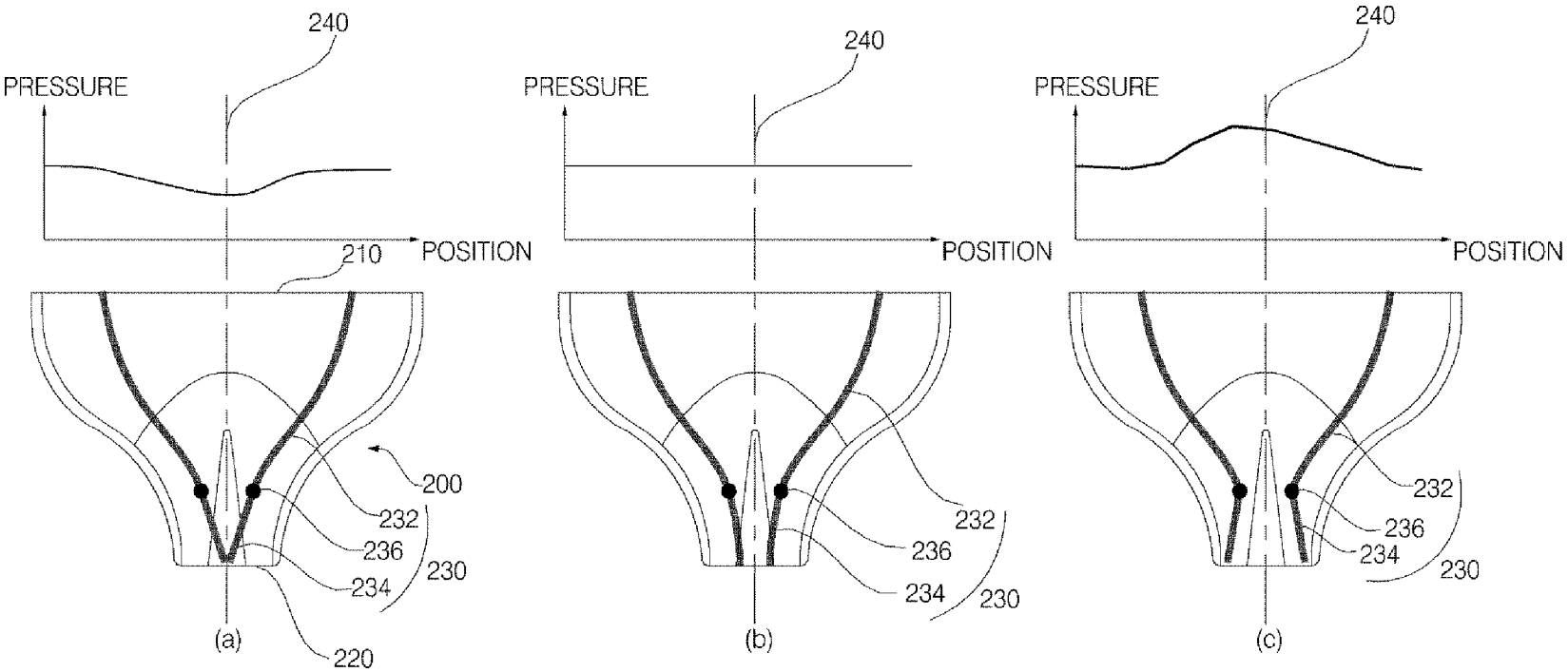
FIG. 3 are respective views illustrating positions of a nozzle guide for modifying increasing air pressure in the left and right sides of a nozzle discharge port of a variable nozzle, for equalizing air pressure in the nozzle discharge port of the variable nozzle, and for increasing air pressure in the center side of the nozzle discharge port of the variable nozzle according to an embodiment of the present disclosure.

When the blower 1 according to the present embodiment is used to gather and push water, as illustrated in section (a) of FIG. 3, the ends of the pair of movable guides 234 may be provided so as to converge close to the left-and-right center axis 240. Once the ends of the pair of movable guides 234 have converged close to the left-and-right center axis 240, relatively high-pressure air may be discharged from the left and right sides of the nozzle discharge port 210.

When the blower 1 according to the present embodiment is used to spread water, as illustrated in section (c) of FIG. 3, the ends of the pair of movable guides 234 may be provided so as to be farther away from the left-and-right center axis 240. Once the ends of the pair of movable guides 234 have been moved to be located farther away from the left-and-right center axis 240, relatively high-pressure air may be discharged from the center of the nozzle discharge port 210.

In addition, when the blower 1 according to the present embodiment is used to push water like a broom, as illustrated in section (b) of FIG. 3, the ends of the movable guides 234 may be located between the positions of the ends of the movable guides 234 in section (a) of FIG. 3 and the positions of the ends of the movable guides 234 in section (c) of FIG. 3 so that even pressure is applied throughout the nozzle discharge port 210. The positions of the ends of the movable guides 234 in section (b) of FIG. 3 may be set through, for example, experimentations to optimize air flow, water movement, noise levels, etc.

The positions of the movable guides 234 illustrated in sections (a) to (c) of FIG. 3 are provided merely as examples according to certain embodiment. In other examples, the movable guides 234 may be provided within the range between the examples shown in sections (a) and (b) of FIG. 3 or within the range between the examples shown in sections (b) and (c) of FIG. 3.

Figure 4:
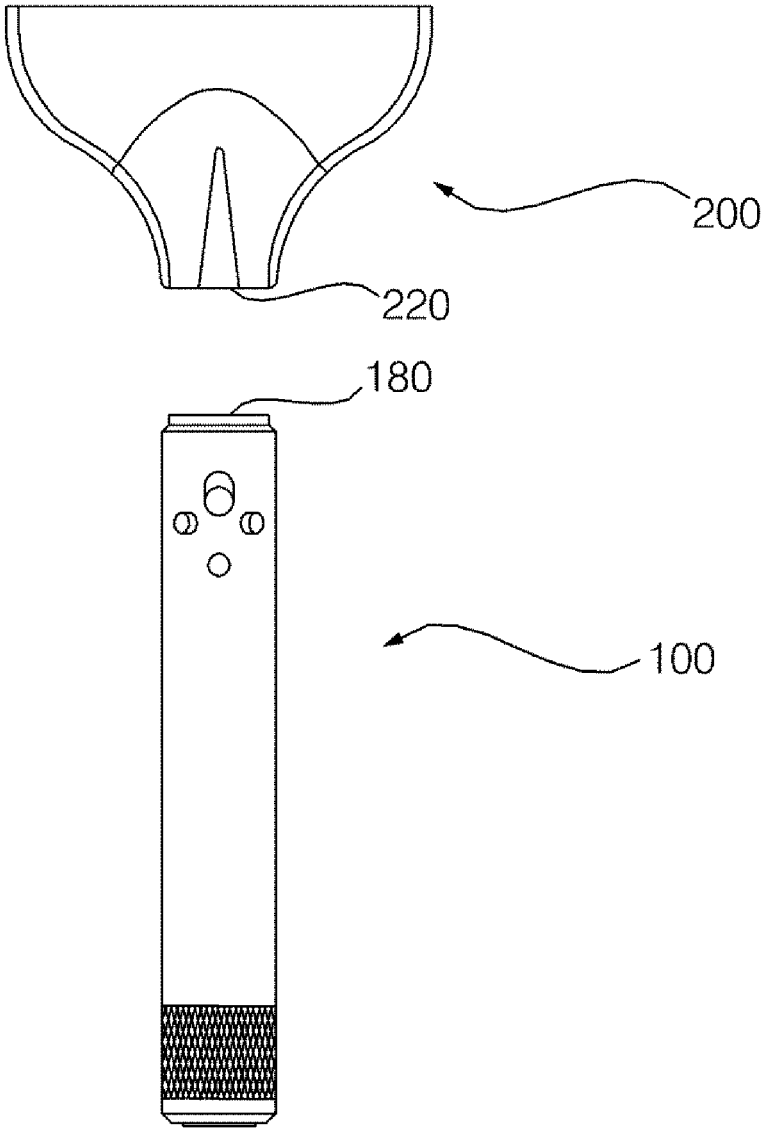
FIG. 4 is a view for explaining the coupling relationship between the blower main body and the variable nozzle according to an embodiment of the present disclosure.

Referring to FIG. 4, the blower main body 100 and the variable nozzle 200 may be separably coupled to each other. The portion of the blower main body 100 in which the main body discharge port 180 is formed and the portion of the variable nozzle 200 in which the nozzle suction port 220 is formed may be coupled to each other. In the blower 1 according to one embodiment, any one of the portion of the blower main body 100 in which the main body discharge port 180 is formed or the portion of the variable nozzle 200 in which the nozzle suction port 220 is formed may be provided with a magnet, and the other one thereof may be magnetically attracted by the magnet. The above-described magnet-type coupling is may be used in one embodiment, but it should be appreciated that the blower main body 100 and the variable nozzle 200 may be coupled to each other in a threaded manner or any other types of coupling that may be implemented by those skilled in the art.

The blower main body 100 according to one embodiment may be mounted on one side of the washstand cabinet 10 and may serve as a device for selectively drying one or more of the washstand or the user's hands or body. The configuration of the washstand cabinet 10 will be described with reference to FIGS. 5 to 8. The washstand cabinet 10 according to the one embodiment may include a washstand 20, which may include a water supply valve 22, a washing bowl 24, and a drying nozzle 400 provided on one side thereof to discharge air so as to dry the user's hand or the washing bowl 24, the blower main body 100, which moves air to the drying nozzle 400, and a housing 30, which may be provided under the washstand 20 to define the external shape of the washstand cabinet 10 and may include a blower mount 310 on one side of which the blower main body 100 may be mounted. The drying nozzle 400 may be changed in orientation so as to discharge air in the direction parallel to or orthogonal to the wall surface to which the washstand 20 may be attached.

The washstand 20 may be an appliance that is provided on the wall surface of a toilet or a bathroom and may be configured to allow a user to wash his/her hands or face. The water supply valve 22 may be provided on the upper end of the washstand 20. The washing bowl 24 may be provided in the center of the washstand 20 to accommodate water therein. In addition, the washstand 20 may be connected to a drain facility (or drain pipe), that is not illustrated and that drains the water accommodated in the washing bowl 24.

The washing bowl 24 may use, for example, an enameled basin or an earthenware basin. In the present embodiment, the washing bowl may be modified into various other forms, and an enameled basin may be used in one example, to enable the housing to be easily coupled to the bottom thereof.

Figure 5:
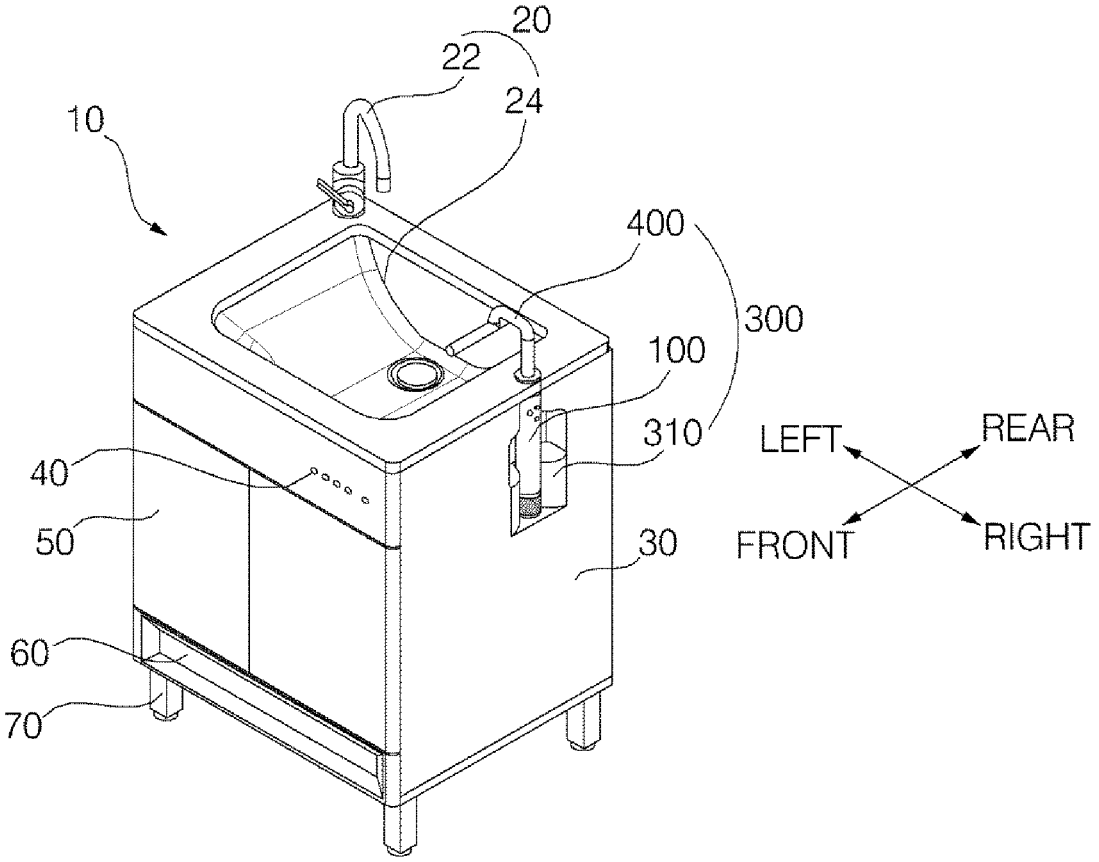
FIG. 5 is a perspective view of a washstand cabinet having a drying nozzle according to an embodiment of the present disclosure.
Figure 6:
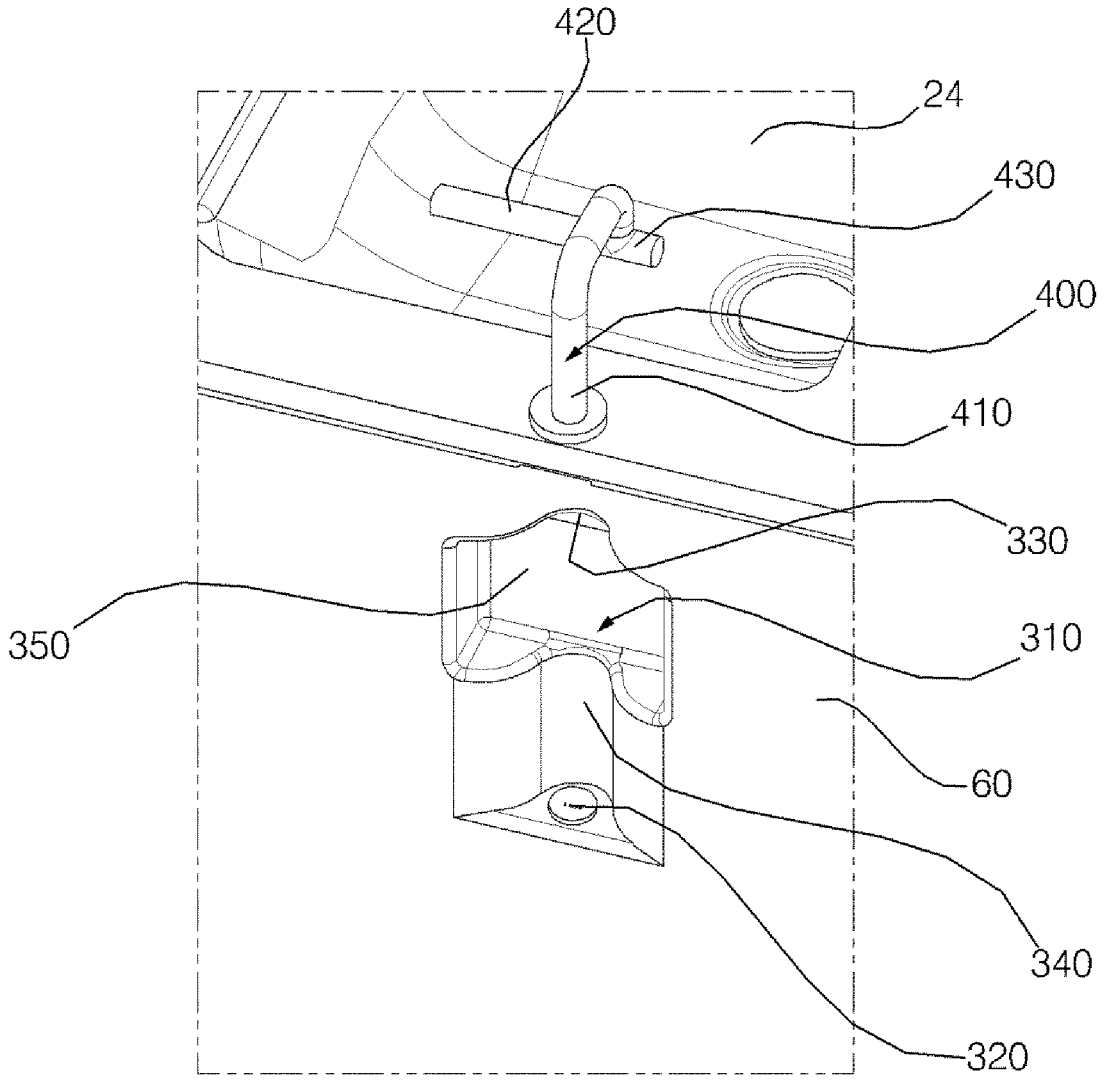
FIG. 6 is a view for explaining a blower mount according to an embodiment of the present disclosure.
Figure 7:
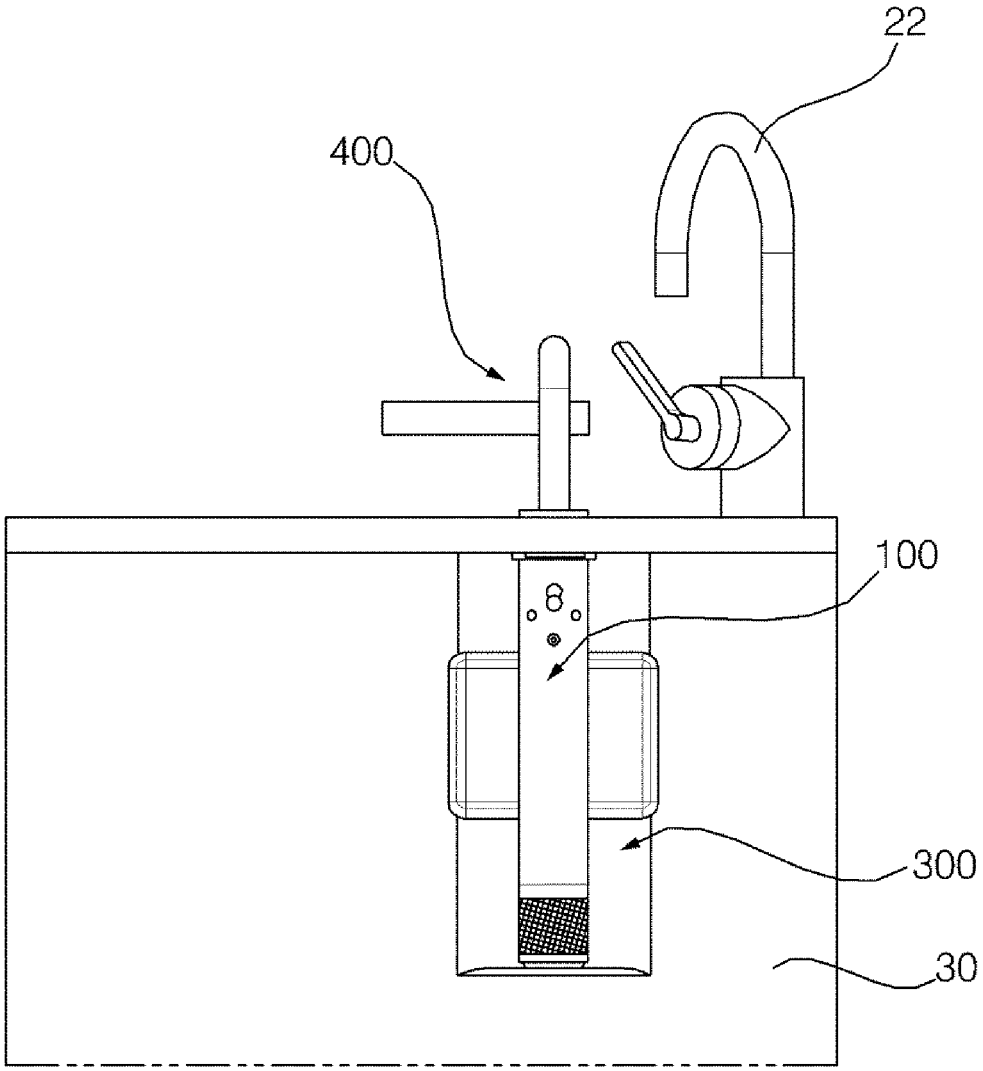
FIG. 7 is a view illustrating the state in which the blower main body is mounted on the blower mount of the washstand cabinet according to an embodiment of the present disclosure.

As illustrated in FIG. 5, hereinafter, the direction in which the user is located relative to the washstand cabinet 10 may be referred to as the front direction, the direction that corresponds to the wall surface to which the washstand is attached may be referred to as the rear direction, and the direction in which the blower mount 310 is installed may be referred to as the left-and-right direction. These directions are provided merely to provide an example of the washstand cabinet 10 in which a drying nozzle 400 according to the present embodiment may be installed, and the orientation of each element in the discussed embodiments is not limited thereto.

The drying nozzle 400 may be provided on one side of the washstand 20 so as to discharge air toward the washing bowl 24, or to discharge air in order to dry the user's hand. For example, the drying nozzle 400 may be provided on the left side or the right side of the washstand 20.

The drying nozzle 400 may include a spray nozzle 420, which discharges air toward the washing bowl 24, and a connection nozzle 410, which sends air moved from the blower main body 100 to the spray nozzle 420. The spray nozzle 420 may have a drying nozzle discharge port, with an oblong slit shape that in relatively thin in one direction and relatively long in another direction so as to discharge air within a wide range. As described below, the orientation of the spray nozzle 420 may be changed depending on the use purpose to direct the drying output air flow.

Figure 8:
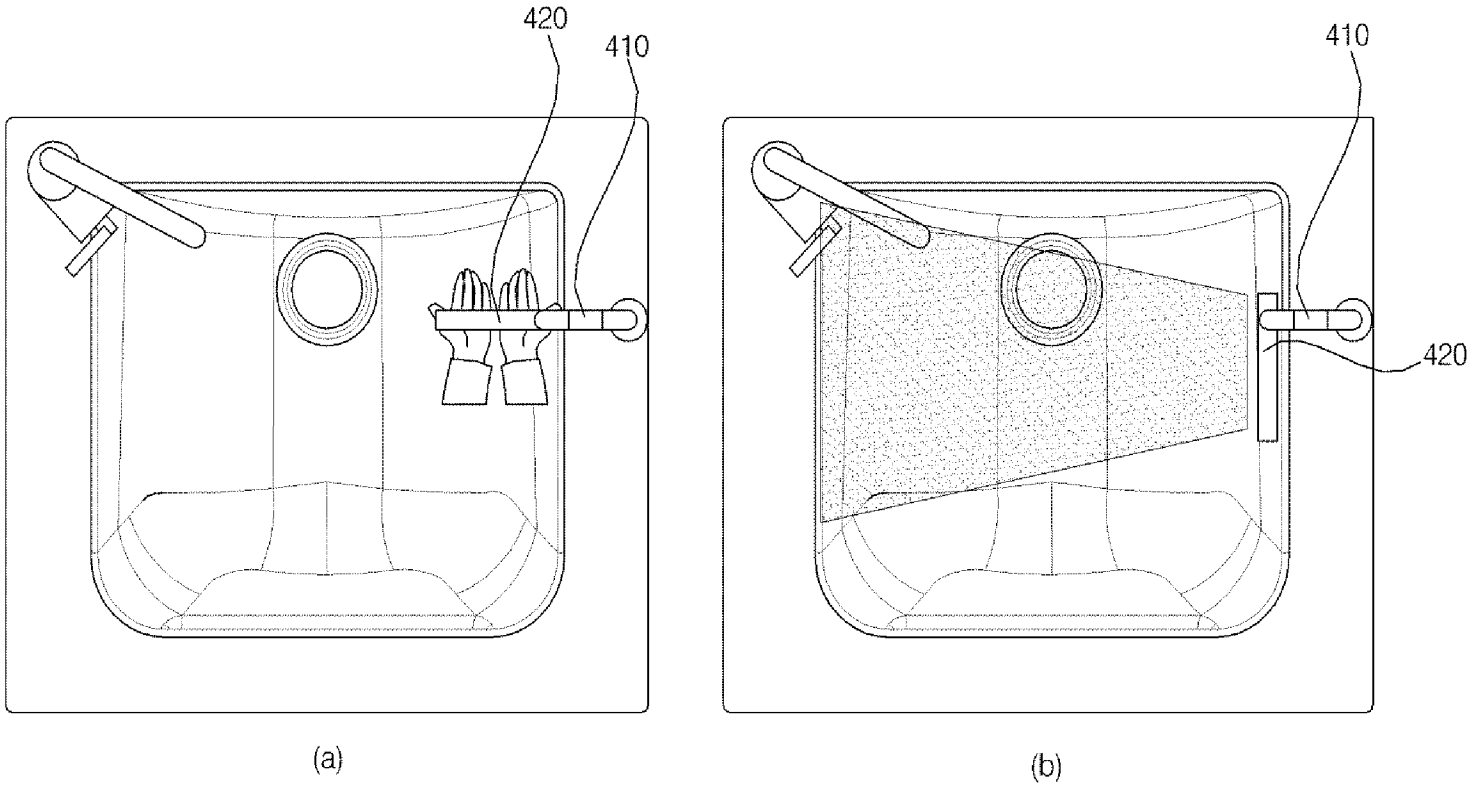
FIG. 8 are views illustrating the respective orientations of the drying nozzle that dries the user's hand and dries a washing bowl according to an embodiment of the present disclosure.

When drying the user's hand using the drying nozzle 400, as illustrated in section (a) of FIG. 8, the spray nozzle 420 may be provided so as to extend in the washstand left-and-right direction, which may be parallel to the wall surface to which the washstand 20 is attached. When the spray nozzle 420 extends in the washstand left-and-right direction at the upper side of the washing bowl 24, the spray nozzle 420 may discharge air toward the user's hand so as to remove or otherwise dry water remaining on the user's hand. The water removed from the user's hand may fall to the washing bowl 24.

When drying the washing bowl 24 using the drying nozzle 400, as illustrated in section (b) of FIG. 8(, the spray nozzle 420 may be provided so as to extend in the washstand front-and-rear direction, which may be orthogonal to the wall surface to which the washstand 20 is attached. When the spray nozzle 420 extends lengthwise in the washstand front-and-rear direction, the spray nozzle 420 may discharge air to the side surface of the washing bowl 24 so as to widely spread water remaining in the washing bowl 24 and dry the washing bowl 24 via a forced convection.

The spray nozzle 420 may be rotatably connected to the connection nozzle 410. The drying nozzle 400 may include a rotator (or movable joint) 430, which rotates the spray nozzle 420 at the end of the connection nozzle 410. The rotator 430 may rotate the spray nozzle 420 about the end of the connection nozzle 410.

The spray nozzle 420 may extend in opposite directions from the portion thereof that is connected to the connection nozzle 410 in the direction orthogonal to the connection nozzle 410. One of the opposite extending portions of the spray nozzle 400 that are orthogonal to the connection nozzle 410 may extend longer than the other. The spray nozzle 420 may not be connected at the center thereof to the connection nozzle 410, but may be connected at a laterally deviated portion thereof to the connection nozzle 410.

When the spray nozzle 420 is provided so as to be parallel to the wall surface to which the washstand 20 is attached, a discharge port thereof may be located above the washing bowl 24 so that water falling from the user's hand may be directed to the washing bowl 24. When the spray nozzle 420 is provided in the direction orthogonal to the wall surface to which the washstand 20 is attached, the discharge port thereof may face the slope formed at the side end of the washing bowl 24.

The housing 30 may be provided under the washstand 20 and may define the external shape of the periphery and bottom of the washstand cabinet 10. The top of the housing 30 may be connected to the washing bowl 24. In order to prevent water used in a bathroom from entering the inside of the housing 30, the washing bowl 24 may be sealed at the portion thereof that is connected to the housing 30.

The blower mount 310 may be formed on the side surface of the housing 30 so that the blower main body 100 may be mounted on the blower mount 310. The blower mount 310 may be provided with a charge unit 320 on the lower surface thereof. The charge unit 320 may be formed on the portion in which the charge unit 320 may be in contact with the charge terminal 130 when the blower main body 100 is mounted on the blower mount 310. The charge unit 320 may supply power to the charge terminal 130 so as to charge the rechargeable battery 140 inside the blower main body 100, or may supply power to the air-conditioning module 160. The charge unit 320 may be connected to the charge terminal 130 via a wire so that the air-conditioning module 160 inside the blower main body 100 may be controlled via an input unit 40 provided on the washstand cabinet 10.

The blower mount 310 has a connection hole 330 formed in the upper surface thereof for connection with the drying nozzle 400. The blower main body 100 may be mounted on the blower mount 310 to move air to the drying nozzle 400. The air-conditioning module 160 inside the blower main body 100 may move air to the top of the blower main body 100 so as to discharge the air to the spray nozzle 420 of the drying nozzle 400.

The blower mount 310 may include a contact portion 340, which comes into contact with a portion of the blower main body 100 and surrounds the blower main body 100 so that the blower main body 100 may be accommodated and fixed in the contact portion 340, and a recessed separable-coupling portion 350, which defines therein the space into which the blower main body 100 may be easily coupled by the user in the state in which the blower main body 100 may be mounted on the blower mount 310.

The housing 30 may be provided on the bottom thereof with cabinet legs 70 for spacing the washstand cabinet 10 apart from the floor of the bathroom by a given distance. However, the cabinet legs 70 may be omitted according to, for example, the use purpose of the washstand cabinet 10 and the space inside the washstand cabinet 10. When the cabinet legs are omitted, the bottom of the housing 30 may directly contact the floor of the bathroom. In one example, the housing bottom and the floor of the bathroom may be sealed in order to prevent water used in the bathroom from entering the inside of the housing 30.

At least one module (not illustrated) may be provided inside the housing 30, and the washstand cabinet 10 may further include a module case 50 in which the module may be accommodated. The module provided inside the housing 30 may be an electric device that may be used in the bathroom. The module may have a standard exterior shape, and may perform various functions depending on the type thereof. The module may include, for example, a warmed storage module for warming towels or other bathroom items stored in the washstand cabinet 10 or a cooled storage module for cooling makeup or other personal stored in the washstand cabinet 10. In one example, the washstand cabinet 10 may further include a dryer 60 that outputs a flow of dried air toward a floor of the bathroom. The dryer 60 may include, for example, a fan and heater to warm and dry a flow of air generated by the fan.

The input unit (or user interface) 40 may be provided on the upper portion of the housing 30 and may be used to input a command to a controller, which may be provided inside the washstand cabinet 10 to control the module. The input unit 40 may be formed on the upper portion of the housing 30 immediately below the washstand 20 at a position at which the user may conveniently operate the input unit 40 in a standing posture.

The input unit 40 may include, for example, a button for receiving a control command related to the operation of the module or the air-conditioning module 160 of the washstand cabinet 10 from the user. In addition, a display (not illustrated), such as, for example, an liquid crystal display (LCD) or a light emitting diode (LED)-type display may be provided to visually display information regarding the operating state of the drying module 300 or another component of the washstand cabinet 10. The input unit 40 may be formed as a touch panel to simultaneously perform the function of a display and to receive a user input.

The controller (not illustrated) may be provided on the rear surface of the input unit 40 or otherwise inside the housing 30 to recognize and control the drying module or other module received in the washstand cabinet 10. The controller may control the air-conditioning module 160 inside the blower main body 100 when the blower main body 100 is mounted on the blower mount 310, and may be connected to the input unit 40 to control an input user command.

The washstand cabinet 10 according to the present embodiment may include the washstand 20, and the washstand 20 may include the water supply valve 22 and the washing bowl 24 in which water may be accommodated. The housing 30, which may be provided under the washstand 20 to define the storage space therein, and a drying module 300 may direct an air flow supplied from the blower main body 100 toward the washing bowl 24. The drying module 300 may be changed in orientation so as to discharge the air in the direction parallel to or orthogonal to the wall surface to which the washstand 20 is attached.

The drying module 300 may include the drying nozzle 400 provided on one side thereof to discharge air toward the washing bowl 24, the blower main body 100 may be configured to spray the air to the drying nozzle 400, and the blower mount 310 formed on one side of the washstand cabinet 10 so that the blower main body 100 may be mounted thereon. In this example, the blower mount 310 may be configured to interconnect the blower main body 100 and the drying module 300. The drying nozzle 400, the blower main body 100 and the blower mount 310 may function as described above.

As is apparent from the above description, a blower according to one embodiment may adjust the partial pressure of air to be discharged from a variable nozzle so as to spread or combine water remaining on a washing bowl or the user's hand, which ensures the effective removal of the water. In a washstand cabinet according to one embodiment, a drying nozzle thereof is changeable in orientation so as to discharge air in the direction parallel to or orthogonal to the wall surface to which a washstand is installed. Thereby, the drying nozzle may serve to dry the user's hand or the washstand by being changed in orientation depending on the use purpose thereof.

Accordingly, aspects of the present disclosure provide a blower, which effectively removes water remaining on the bathroom wall or floor in the corner of a bathroom, and provide a washstand cabinet, which may function to dry a washstand or to dry the user's hand when a user has used the washstand.

In accordance with one aspect of the present disclosure, the above and other objects can be accomplished by provisioning of a blower including a blower main body configured to move air and a variable nozzle configured to discharge the air moved from the blower main body to an outside, wherein the variable nozzle may include a nozzle guide configured to adjust a partial pressure of the air to be discharged.

In accordance with another aspect of the present disclosure, there is provided a washstand cabinet including a blower main body configured to move air, a blower mount on which the blower main body is mounted, and a drying nozzle configured to discharge the air moved from the blower main body to a washing bowl, wherein the drying nozzle is changed in orientation so as to discharge the air in a direction parallel to or orthogonal to a wall surface.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A blower comprising:

a blower main body having a cylindrical shape with a main body suction port formed in a first end thereof, a main body discharge port formed in second end thereof, and a cavity extending between the main body suction port and the main body discharge port; and a variable nozzle connected to the second end of the blower main body, the variable nozzle including a nozzle suction port to receive an air flow outputted from the main body discharge port of the blower main body, a nozzle discharge port to discharge the air flow from the variable nozzle, and nozzle guides provided within a path between the nozzle suction port and the nozzle discharge port to adjust a pressure of a portion of the air flow discharged through a portion of the nozzle discharge port, wherein the nozzle guides include:

a pair of fixed guides extending from the nozzle discharge port and provided at fixed positions; and a pair of movable guides extending from the nozzle suction port, the movable guides being configured to change position so as to adjust the pressure of the portion of the air to be discharged through the portion of the nozzle discharge port.

2. The blower according to claim 1, wherein the variable nozzle further includes a pair of hinge points about which the position of the pair of movable guides is changed.

3. The blower according to claim 2, wherein the pair of movable guides is configured to change position so that ends of the pair of movable guides close to the nozzle suction port are moved toward or away from a center of the variable nozzle.

4. The blower according to claim 1, wherein the nozzle discharge port has an oblong slit shape that is relatively longer in a first direction and is relatively shorter in a second direction.

5. The blower of claim 1, further comprising:

a pre-filter provided at the main body suction port to remove contaminants from air suctioned through the main body suction port; and an inner filter provided in the blower main body to remove contaminants from air filtered through the pre-filter.

6. The blower of claim 1, wherein a portion of each of the nozzle guides is movable to direct the air flow toward a peripheral edge of the nozzle discharge port, to direct the air flow toward a center region of the nozzle discharge port, or to distribute the air flow to both the peripheral edge and the center region of the nozzle discharge port.

7. The blower of claim 1, further comprising a fan positioned in the cavity and configured to generate the air flow, and a motor to drive the fan.

8. The blower of claim 7, further comprising a battery to store and provide electrical power to the motor.

9. The blower of claim 7, further comprising a control switch to selectively operate at least one of the motor or the fan.

10. A washstand cabinet comprising:

a washstand including a water supply valve, a washing bowl, and a drying nozzle provided on one side thereof to discharge air to the washing bowl;

a blower configured to move air to the drying nozzle; and a housing provided under the washstand to define an external shape of the washstand cabinet and including a blower mount on one side thereof and configured to receive the blower, wherein the drying nozzle is configured to be changed in orientation so as to selectively discharge the moved air in a first direction parallel to a wall surface to which the washstand is attached or a second direction orthogonal to the wall surface, wherein the blower includes:

a blower main body having a cylindrical shape with a main body suction port formed in a first end thereof, a main body discharge port formed in second end thereof, and a cavity extending between the main body suction port and the main body discharge port; and a variable nozzle connected to the second end of the blower main body, the variable nozzle including a nozzle suction port to receive an air flow outputted from the main body discharge port of the blower main body, a nozzle discharge port to discharge the air flow from the variable nozzle, and nozzle guides provided within a path between the nozzle suction port and the nozzle discharge port to adjust a pressure of a portion of the air flow discharged through a portion of the nozzle discharge port, and wherein the nozzle guides include:

a pair of fixed guides extending from the nozzle discharge port and provided at fixed positions; and a pair of movable guides extending from the nozzle suction port, the movable guides being configured to change position so as to adjust the pressure of the portion of the air to be discharged through the portion of the nozzle discharge port.

11. The washstand cabinet according to claim 10, wherein the drying nozzle includes:

a spray nozzle provided with a drying nozzle discharge port having an oblong shape that is relatively longer in a first direction and relatively shorter in a second direction to spray the air toward the washing bowl;

a connection nozzle configured to send the air moved from the spray nozzle and the blower main body to the spray nozzle; and a movable joint configured to rotate the spray nozzle at an end of the connection nozzle.

12. The washstand cabinet according to claim 11, wherein the spray nozzle extends in opposite directions from a portion thereof that is connected to the connection nozzle in a direction orthogonal to the connection nozzle, and wherein one extending portion of the spray nozzle extends longer than another extending portion.

13. The washstand cabinet according to claim 10, wherein the blower includes:

a case defining an external shape of the blower;

a dryer module provided inside the case to move the air through the case;

a rechargeable battery configured to supply power to the dryer module; and a charge terminal configured to charge the rechargeable battery using an external power source, and wherein the blower mount is provided with a charge outlet on a lower surface thereof to supply power to the charge terminal of the blower main body and to charge the rechargeable battery provided inside the blower main body.

14. The washstand cabinet according to claim 10, wherein the case has a main body suction port formed in a peripheral direction of a lower end thereof and a main body discharge port formed in an upper surface thereof to discharge the air, and wherein the blower mount has a communication hole formed in an upper surface thereof so that the air discharged from the main body discharge port of the blower main body is moved to the drying nozzle through the communication hole.

15. A washstand cabinet comprising:

a washstand including a water supply valve and a washing bowl in which water is accommodated;

a housing provided under the washstand to define a storage space therein; and a drying module configured to spray air supplied from a blower toward the washing bowl, wherein the drying module is configured to be moved between a first orientation in which the air is discharged in a direction parallel to a wall surface to which the washstand is attached, and a second orientation in which the air is discharged in a direction orthogonal to the wall surface; a blower configured to move air to the drying nozzle, the blower includes a blower main body having a cylindrical shape with a main body suction port formed in a first end thereof, a main body discharge port formed in second end thereof, and a cavity extending between the main body suction port and the main body discharge port; and a variable nozzle connected to the second end of the blower main body, the variable nozzle including a nozzle suction port to receive an air flow outputted from the main body discharge port of the blower main body, a nozzle discharge port to discharge the air flow from the variable nozzle and nozzle guides provided within a path between the nozzle suction port and the nozzle discharge port to adjust a pressure of a portion of the air flow discharged through a portion of the nozzle discharge port, and wherein the nozzle guides include a pair of fixed guides extending from the nozzle discharge port and provided at fixed positions and a pair of movable guides extending from the nozzle suction port, the movable guides being configured to change position so as to adjust the pressure of the portion of the air to be discharged through the portion of the nozzle discharge port.

16. The washstand cabinet according to claim 15, wherein the drying module includes:

a drying nozzle provided on one side of the washstand to receive air from the blower and to discharge air toward the washing bowl; and a blower mount formed on one side of the washstand cabinet so that the blower is mounted thereon, the blower mount being configured to interconnect the blower and the drying module, and wherein the drying nozzle is provided with a drying nozzle discharge port having a slit shape, and is changed in orientation so as to discharge air in the direction parallel to the wall surface or the direction orthogonal to the wall surface.

17. The washstand cabinet according to claim 15, further comprising:

a user interface to receive a user input; and a controller to modify an operation of the blower based on the user input.

18. The washstand cabinet according to claim 15, further comprising a module interface to receive one or more electronic modules within the housing.

19. The washstand cabinet according to claim 15, wherein the water supply valve is positioned adjacent to a first lateral edge of the washing bowl; and the drying module is positioned adjacent to a second, opposite lateral edge of the washing bowl.

* * * * *